United States Patent [19]

Gross

[11] 4,010,591

[45] Mar. 8, 1977

[54] MOVABLE PARTITION TRIM PIECE

[75] Inventor: Charles Fleming Gross, Montreal, Canada

[73] Assignee: Domtar Limited, W. Montreal, Canada

[22] Filed: Nov. 3, 1975

[21] Appl. No.: 628,335

[30] Foreign Application Priority Data

Nov. 29, 1974 Canada ..... 214954

[52] U.S. Cl. ..... 52/732; 52/729; 52/716; 52/468

[51] Int. Cl.[2] ..... E04C 3/30; E04C 2/33

[58] Field of Search ..... 52/729, 733, 495, 211, 52/213, 645, 405, 468, 758 D, 716, 713, 588, 481

[56] References Cited

UNITED STATES PATENTS

| | | | |
|---|---|---|---|
| 1,901,624 | 3/1933 | Baum | 52/212 |
| 2,101,073 | 12/1937 | Kotrbaty | 52/405 |
| 2,106,179 | 1/1938 | Kotrbatty | 52/405 |
| 2,164,137 | 6/1939 | London | 52/405 |
| 2,356,309 | 8/1944 | Garbe | 52/732 |
| 2,741,344 | 4/1956 | Herr | 52/645 |
| 2,803,858 | 8/1957 | Rader | 52/468 |
| 2,990,650 | 7/1961 | Attwood | 52/468 |
| 3,357,145 | 12/1967 | Grossman | 52/758 D |
| 3,434,258 | 3/1969 | Leurent | 52/397 |
| 3,945,167 | 3/1976 | Wendt | 52/714 |

*Primary Examiner*—Price C. Faw, Jr.
*Assistant Examiner*—Robert C. Farber
*Attorney, Agent, or Firm*—C. A. Rowley

[57] ABSTRACT

A versatile trim piece comprising of a central U-shaped base member composed of a pair of arms extending substantially perpendicular from opposite ends of a base section and a pair of T-shaped members each formed of a trunk section and a pair of branch sections extending perpendicularly in opposite directions from one end of the trunk sections, the opposite end of each trunk section being integrally connected to a free end of one of said arms, the trunk sections extending substantially perpendicular to said arms and at least the branch sections adjacent the arms terminating in free ends positioned in a plane containing the face of the base section remote from the trunk sections. The trim piece may be used for various applications, for example as a starter member, a ceiling runner, a post section, etc.

3 Claims, 6 Drawing Figures

MOVABLE PARTITION TRIM PIECE

FIELD OF THE INVENTION

The present invention relates to a trim piece. More particularly the present invention relates to a versatile trim piece for modular wall systems.

DESCRIPTION OF THE PRIOR ART

A wide variety of modular wall systems are currently on the market. Each system generally employs a plurality of extruded aluminum trim pieces to secure the panels to the studs or if no studs are used to form panel to panel joints and to provide various track and supporting hardware necessary to form the partitions. In a given system a plurality of different extruded elements must be manufactured, stocked and shipped to construction sites. The greater the number of different elements in a system the greater the inventory and generally the greater the cost of the partition system.

BRIEF DESCRIPTION OF THE INVENTION

It is an object of the present invention to provide a versatile trim piece that may be used for a variety of different applications in a movable wall system.

Broadly the present invention relates to a trim piece comprising a U-shaped central base number composed of a pair of arms extending substantially perpendicular from opposite ends of a base section, and a pair of T-shaped members each formed with a trunk section and a pair of branched sections extending perpendicular to and in opposite directions from one end of each of said trunk sections, the opposite end of each of said trunk sections is integrally connected to a free end of one of said arms, said trunk sections extend substantially perpendicular to said arms and said branch sections adjacent said arms terminating in free ends positioned in a plane containing the face of said base section remote from said trunk sections.

BRIEF DESCRIPTION OF THE DRAWINGS

Further features, objects and advantages will be evident from the following detailed description of a preferred embodiment of the present invention taken in conjunction with the accompanying drawings in which.

DESCRIPTION OF THE PROPOSED EMBODIMENT

Figure 1:
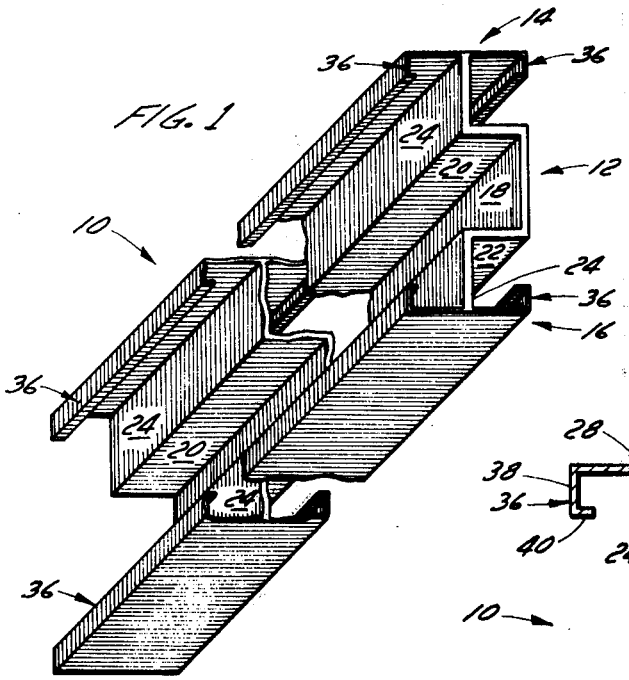
FIG. 1 is an isometric view of the trim piece of the present invention.
Figure 2:
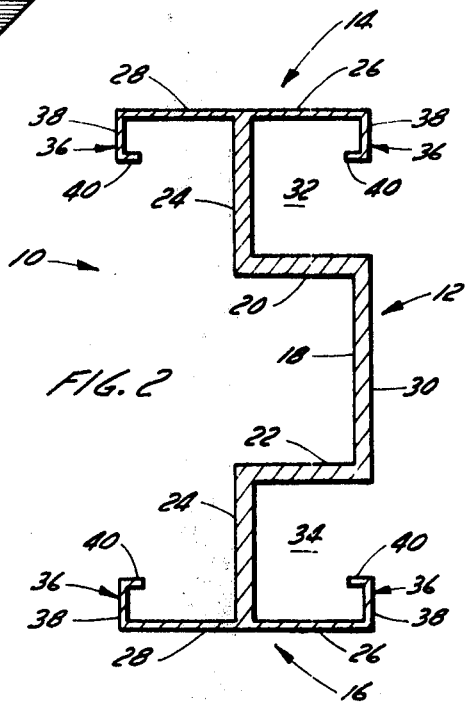
FIG. 2 is a section through a trim piece of the present invention.

As shown in FIGS. 1 and 2 the trim piece 10 is an elongated extrusion having a central U-shaped central base member 12 and a pair of substantially T-shaped members 14 and 16.

The U-shaped member 12 is formed with a base section 18 and a pair of arms 20 and 22 projecting perpendicular to the base section 18 from opposite ends thereof.

The T-shaped members 14 and 16 are substantially identical and each is composed of a trunk section 24 and a pair of branch sections 26 and 28 positioned in substantially the same plane and projecting substantially perpendicular to and in opposite directions from the free end of the trunk sections 24.

The trunk sections 24 are integrally connected to and extend substantially perpendicularly from the arms 20 and 22, i.e. they are parallel to the base section 18 while the branch sections 26 and 28 of each of the T members 14 and 16 are parallel to the arms 20 and 22. The branches 26 which extend from the trunk sections 24 in substantially the same direction as the arms 20 and 22 terminate in the same plane as the back face 30 of the base section 18 and define with the trunk sections 24 and the arms 20 and 22 receiving pockets 32 and 34 on opposite sides of the base member 12 (See also FIGS. 3 and 4).

Preferably the branches 26 and 28 will be provided with L-shaped projections 36 each formed by a mutually perpendicular leg 38 and flange 40. Legs 38 are connection to the free ends of the branches 26 and 28 and extend substantially perpendicular thereto while the flanges 40 extend perpendicularly from the free ends of the legs 38 toward the trunk section 24.

Figure 3:
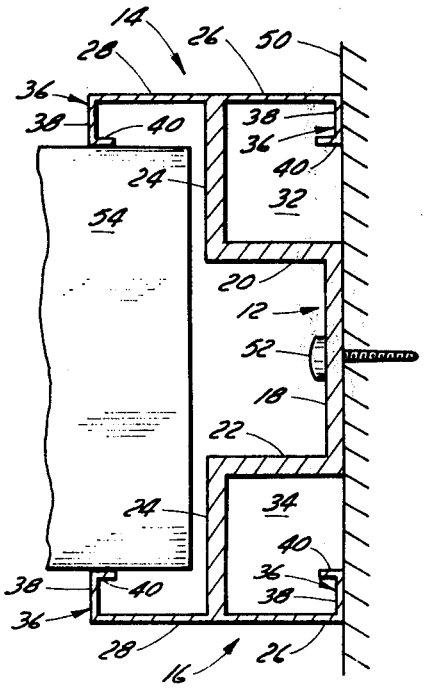
FIG. 3 is a section of the trim piece used as a wall starter or as a ceiling runner with a panel received therein.
Figure 4:
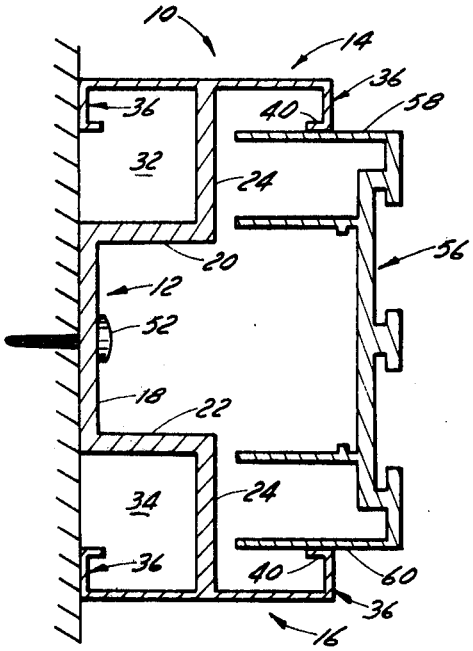
FIG. 4 is a view similar to FIG. 3 illustrating the trim member holding a window frame.

The branches 26 and 28 and the arms 20 and 22 will preferably be of equal length so that the legs 38 connected to the branches 26 will be in substantially the same plane as the base section 18 so that when the trim piece 10 is mounted against the wall the faces of the legs 38 and of the base 18 (face 30) will abutt against the plainer surface of the wall or ceiling as shown in FIGS. 3 and 4.

In FIG. 3 the trim piece 10 is shown mounted on a wall 50 by means of screws generally indicated at 52. The face 30 of the base section 18 and the faces of arms 38 are flush with the wall 50 and provide a relatively stable base for starting a wall. In the FIG. 3 arrangement a solid core panel 54 is shown as received between the flanges 40 connected to the T-shaped members 14 and 16 respectively. Panel 54 is snugly received between the flanges 40 and may, if desired, be forced into the trim piece 10 into abuttment with the trunk sections 24 (in the illustrated arrangements the panel is shown as slightly spaced therefrom).

FIG. 4 is a view quite similar to FIG. 3 but the panel 54 has been replaced by a window frame member 56. The flanges 58 and 60 of the window frame member 56 are snugly received between the flanges 40 of the T-shaped elements 14 and 16 in the same manner as the panel 54 of FIG. 3 was received.

Figure 5:
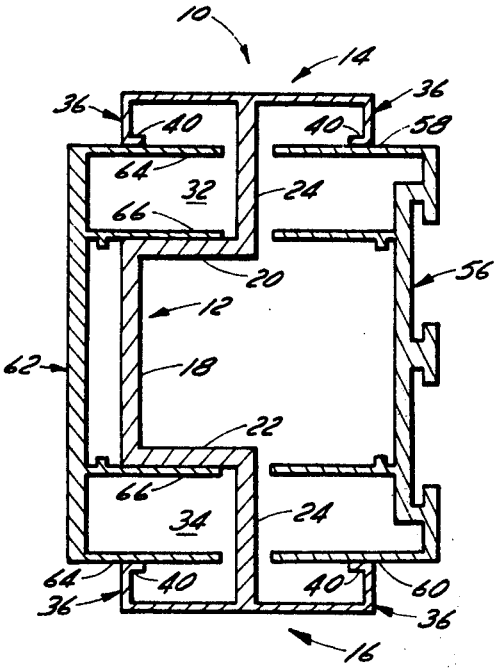
FIG. 5 illustrates the trim member forming a post between an end section and a window frame.

In FIG. 5 the trim piece 10 forms a post with a window frame member 56 on one side and an end section 62 on the opposite side. The window frame section is held in position in the same manner as section 56 shown in FIG. 4 while the end section 62 is held in position by the arms 64 and 66 at opposite ends thereof being snugly received in the pockets 32 and 34, i.e. the arms 64 are frictionally engaged by the flanges 40 extending from the branches 26 of the T-shaped elements 14 and 16 and the arms 66 frictionally engage the arms 20 and 22 of the base member 12.

Figure 6:
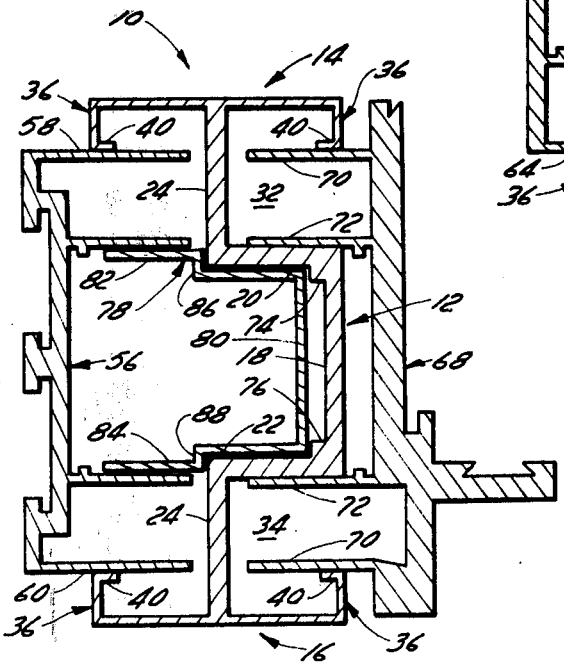
FIG. 6 is a view similar to FIG. 5 illustrating a modified trim section reinforced and functioning as a post between a window and door frame.

In FIG. 6 a door jam member 68 has been substituted for the end section 62. The member 68 is held in position in the pockets 32 and 34 by the pairs of arms 70 and 72 positioned in the opposite sides of the member 68. The arms 70 and 72 frictionally engage respectively the flanges 40 and the arms 20 and 22 respectively.

In FIG. 6 the element 10 has been modified to include abuttments 74 and 76 positioned at opposite ends of the base 18 at the junction of the base section 18 with the arms 20 and 22. The post structure also has been reinforced by a U-shaped element 78 formed from a base 80 with a pair of arms 82 and 84 each of which has an offset section as indicated by 86 and 88 respectively. This reinforcing element 78 is not essential and may be omitted as may the abuttments 74 and 76, however, in some instances it may be preferred to reinforce the structure (for example a post between a window and door). The reinforcing element 78 may be used with or without the abuttments 74 and 76 which limit the penetration of the reinforcing 78 into the U-shaped base member 12.

The trim piece 10 preferably will be formed with extruded aluminum, however, any other suitable materials may be used.

Modifications may be made without departing from the spirit of the invention as defined in the appended claims.

I claim:

1. A trim piece comprising a central U-shaped base member composed of a pair of arms extending substantially perpendicular to and in substantially the same direction from opposite ends of a base section and a pair of T-shaped members each formed of a trunk section and a pair of branch sections extending perpendicular to and in opposite direction from one end of said trunk section, the opposite end of each trunk section being integrally connected to a free end of one of said arms, said trunk sections extending substantially perpendicular to said arms and said branch sections adjacent said arms terminating in free ends positioned in a plane containing the face of said base section remote from said trunk sections.

2. A trim piece as defined in claim 1 wherein said branch sections are all of substantially equal length.

3. A trim piece as defined in claim 2 further comprising L-shaped projections extending perpendicular from the free ends of said branch sections, said L-shaped projections each having a leg section integral with and substantially perpendicular to their respective branch sections and a flange substantially perpendicular to said leg sections and projecting from the free end of said leg section toward said trunk section, the faces remote from said trunk section of said leg sections adjacent said base section being positioned in said plane.

* * * * *